US009671115B2

(12) United States Patent
Elkasevic

(10) Patent No.: US 9,671,115 B2
(45) Date of Patent: Jun. 6, 2017

(54) HOME APPLIANCE WITH A TELESCOPIC RACK

(71) Applicant: BSH Home Appliances Corporation, Irvine, CA (US)

(72) Inventor: Suad Elkasevic, Winterville, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 245 days.

(21) Appl. No.: 13/681,511

(22) Filed: Nov. 20, 2012

(65) Prior Publication Data

US 2014/0137856 A1 May 22, 2014

(51) Int. Cl.
*F24C 15/16* (2006.01)

(52) U.S. Cl.
CPC ..... *F24C 15/168* (2013.01)

(58) Field of Classification Search
CPC ..... F24C 15/168
USPC ..... 126/339, 332, 337 R
See application file for complete search history.

(56) References Cited

U.S. PATENT DOCUMENTS

| | | | | |
|---|---|---|---|---|
| 1,946,532 | A * | 2/1934 | Hatch | 108/143 |
| 1,974,983 | A * | 9/1934 | Cook | 108/137 |
| 2,008,091 | A * | 7/1935 | Betts | 108/137 |
| 2,033,792 | A * | 3/1936 | Sywert et al. | 211/153 |
| 2,033,859 | A * | 3/1936 | Otte | 312/408 |
| 2,033,861 | A * | 3/1936 | Otte | 312/408 |
| 2,078,681 | A * | 4/1937 | Otte | 312/246 |
| 2,633,400 | A * | 3/1953 | Ring | F24C 15/16 126/339 |
| 2,804,068 | A * | 8/1957 | Miller et al. | 126/337 R |
| 4,651,713 | A * | 3/1987 | Ondrasik, II | 126/339 |
| 6,148,813 | A | 11/2000 | Barnes et al. | |
| 6,938,617 | B2 | 9/2005 | Le et al. | |
| 6,976,597 | B2 | 12/2005 | Jährling et al. | |
| 7,087,862 | B1 | 8/2006 | Shaffer et al. | |
| 7,216,646 | B2 * | 5/2007 | Le et al. | 126/339 |
| 7,316,179 | B2 * | 1/2008 | Geberzahn et al. | 99/340 |
| 8,646,444 | B2 * | 2/2014 | Williams et al. | 126/339 |
| 8,820,314 | B1 * | 9/2014 | Johnson et al. | 126/339 |
| 2007/0261694 | A1 * | 11/2007 | Le et al. | 126/339 |
| 2008/0047542 | A1 * | 2/2008 | Hughes | 126/339 |
| 2008/0237166 | A1 * | 10/2008 | Williams et al. | 211/169.1 |
| 2010/0218755 | A1 * | 9/2010 | Stewart et al. | 126/339 |
| 2011/0132348 | A1 * | 6/2011 | Smith et al. | 126/339 |
| 2012/0055896 | A1 * | 3/2012 | Le et al. | 211/94.01 |
| 2012/0138041 | A1 * | 6/2012 | Jahrling | 126/19 R |

* cited by examiner

*Primary Examiner* — Avinash Savani
*Assistant Examiner* — Aaron Heyamoto
(74) *Attorney, Agent, or Firm* — Michael E. Tschupp; Andre Pallapies

(57) ABSTRACT

A home appliance with a telescopic rack including a cavity with walls having an opposing set of ribs, a rack with opposing side edges, a slide coupled to an opposing side edge, and a brace coupled to the slide and capturing the opposing set of ribs.

32 Claims, 6 Drawing Sheets

HOME APPLIANCE WITH A TELESCOPIC RACK

FIELD OF THE INVENTION

The invention relates to a home appliance with telescopic rack. More particularly, the invention relates to a home oven appliance having a ribbed oven cavity wall and a rack that telescopically extends from the oven cavity along ribs in the cavity wall.

BACKGROUND OF THE INVENTION

Conventional home appliances with telescopic racks typically rely upon ladder type frames, which are attached to side walls of a cavity to support racks for the placement of food and cookware items. The racks may be telescopic, allowing the racks to be extended, at least partially, out of the cavity. These telescopic racks generally have a "slide" type mechanism on opposing sides of the rack with a linear bearing that is attached to the ladder type frame on one side and to the rack on the other, the rack extends horizontally across the interior of the cavity to another linear slide mechanism on an opposite side, which, in turn, is attached to another ladder type frame attached to the opposing side of the cavity. These home appliances are expensive because of the added cost and complexity of providing a ladder frame attached to the cavity wall. Manufacturing costs are increased because of the increase in assembly costs of the ladder frame into the oven cavity and also the cost of the ladder frame on its own.

Another type of home appliance has a cavity that includes racks that do not require a ladder type frame. This type of appliance relies upon the interior wall surface of the cavity to have ribs that directly support a rack in the cavity. There are a number of advantages of a ribbed cavity. A ribbed cavity has improved cavity strength, increased cavity volume, and no additional rack support parts (ladder frame attachments) are required. Therefore, in a ribbed cavity, usable cavity volume is increased, the overall cavity strength is improved, there are less parts (no additional cost for a ladder frame), and there is less variation in parts. Therefore, overall quality and usability of the appliance is improved. However, racks typically used in ribbed cavities do not conventionally include slide rails with linear bearings for ease of extending and retracting the oven rack. Rather, these racks typically rest directly on the ribs and may extend only partially from the cavity by directly sliding upon the ribs in the side walls of the oven.

A number of home appliances having telescopic racks have been developed to be used with the various types of cavities, e.g., ribbed and non-ribbed.

U.S. Pat. No. 4,651,713 discloses a home appliance with a slide out rack that rest directly on the ribs and may partially extend from the cavity by directly sliding upon the ribs in the side wall of the cavity.

U.S. Pat. No. 6,148,813 discloses a home appliance with a rack assembly with a rack frame having rollers and roller guides to facilitate extending a rack.

U.S. Pat. No. 6,938,617 discloses a home appliance with a rack having a rack frame resting on ledges of an interior of the cavity. The rack is coupled to extension slides which are coupled to opposing margins of the rack, and the slides enable the extension of the rack from a position within the cavity to a position outside the cavity.

U.S. Pat. No. 7,087,862 discloses a home appliance with a rack assembly including a pair of laterally spaced inner rails, wherein each inner rail includes a coating layer that survives a high temperature self-clean, and a pair of laterally spaced outer rails. Each outer rail is slidably coupled to a corresponding inner rail, and each outer rail includes a coating layer that survives a high temperature self-clean. The rack assembly also includes a plurality of bearings positioned between the inner rails and the outer rails, a lubricant to facilitate movement between the plurality of bearings, the inner rails and the outer rails. The lubricant of this home appliance maintains its lubricating properties even after being exposed to a high temperature self clean cycle.

The above described home appliances have various disadvantages. For example, none of the conventional home appliances provide a reliable mechanism that secures a rack assembly to ribs on the interior wall surface of the cavity in a manner that prevents the rack from being inadvertently becoming completely disconnected from the cavity when, for example, extending the rack out of the cavity, nor do they provide a reliable mechanism to keep the rack from tilting when the rack is extended out of the cavity, especially while the rack supports a cooking vessel.

The above described conventional home appliances also do not provide a reliable mechanism that prevents the rack from hitting a back wall of the cavity when the rack is fully retracted into the cavity. Further, a number of the conventional home appliances include racks that rest directly on the ribs, without any type of bearing/slide assembly, thus making it difficult to extend and retract the rack. Further still, conventional home appliances fail to provide a reliable chassis design for a telescopic rack that facilitates maintaining the structural integrity of the telescopic rack, preventing the telescopic rack from warping, bending in, and/or skewing during use or over time, which may cause the telescopic rack to become unintentionally disengaged from the support ribs in the cavity.

SUMMARY OF THE INVENTION

An exemplary embodiment of the present invention overcomes the problems of the conventional home appliances by providing a home appliance with a telescopic rack that includes a cavity with an opposing set of ribs on walls of the cavity, a rack with opposing side edges, a slide coupled to an opposing side edge, and a brace coupled to the slide and capturing the opposing set of ribs. In this manner, the present invention provides a home appliance with a telescopic rack that does not require the expense of a providing a ladder frame and assembling a ladder frame into the appliance, but provides all of the advantages of easy motion of the rack, through the use of a slide, and having the telescopic rack directly supported by ribs in the cavity wall.

BRIEF DESCRIPTION OF THE DRAWINGS

These and other features of this disclosure will be more readily understood from the following detailed description of the various aspects of the disclosure taken in conjunction with the accompanying drawings that depict exemplary embodiments of the invention, in which.

DETAILED DESCRIPTION OF THE INVENTION

Exemplary embodiments of the present invention are described more fully below with reference to the accompanying drawings. This invention may, however, be embodied in many different forms and should not be construed as limited to the described embodiments.

An exemplary embodiment of the present invention provides a home appliance with a telescopic rack having slides (e.g., rails), with bearings (e.g., linear bearings), for use within an oven cavity having ribbed opposing side walls. This embodiment also includes braces that are coupled to the slides and which are shaped to capture a rib in the wall of the oven cavity, and to maintain the integrity of the telescopic rack.

Figure 1A:
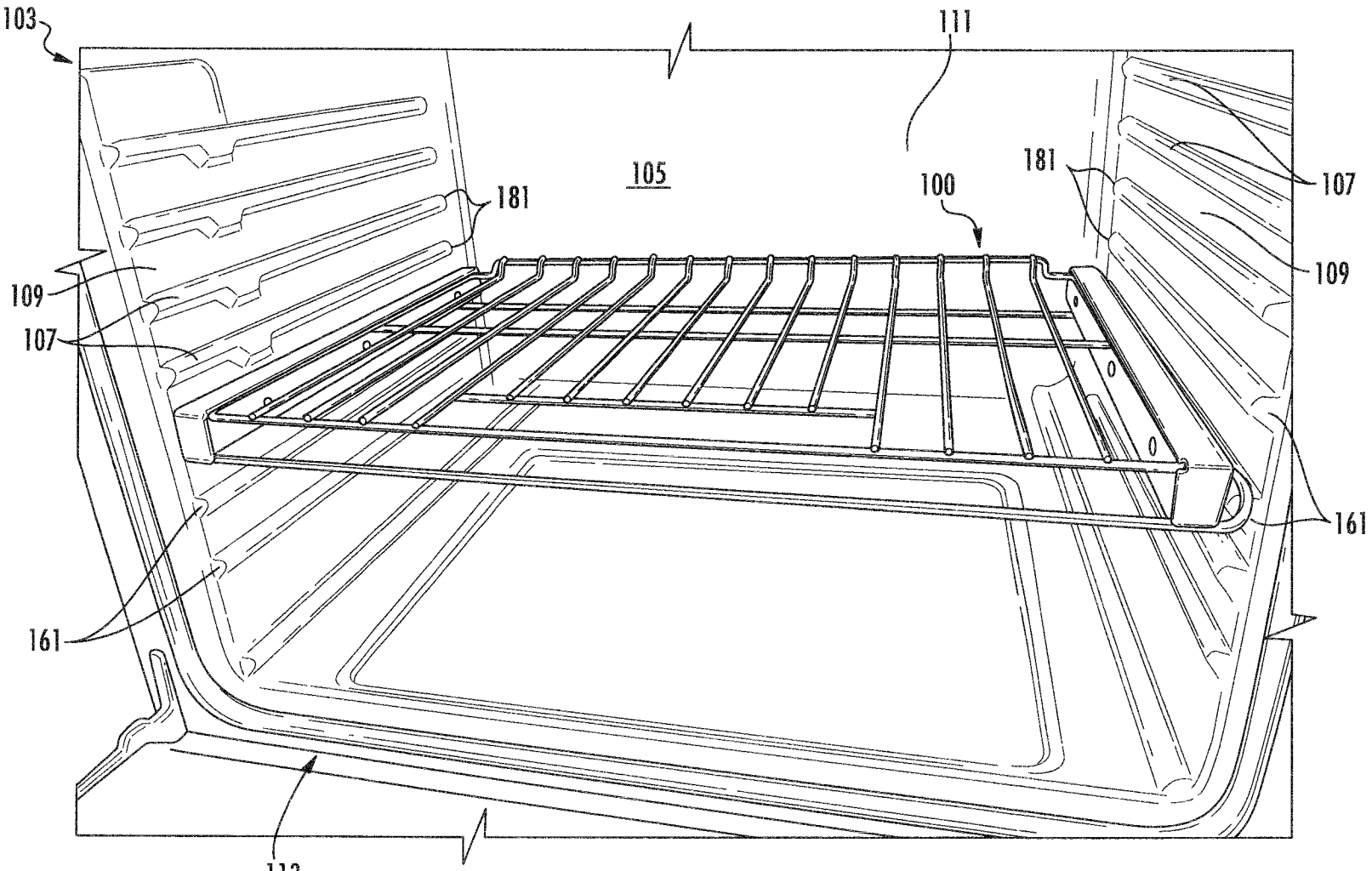
FIG. 1A illustrates an interior of a home appliance cavity with a telescopic rack in accordance with an exemplary embodiment of the invention.
Figure 1B:
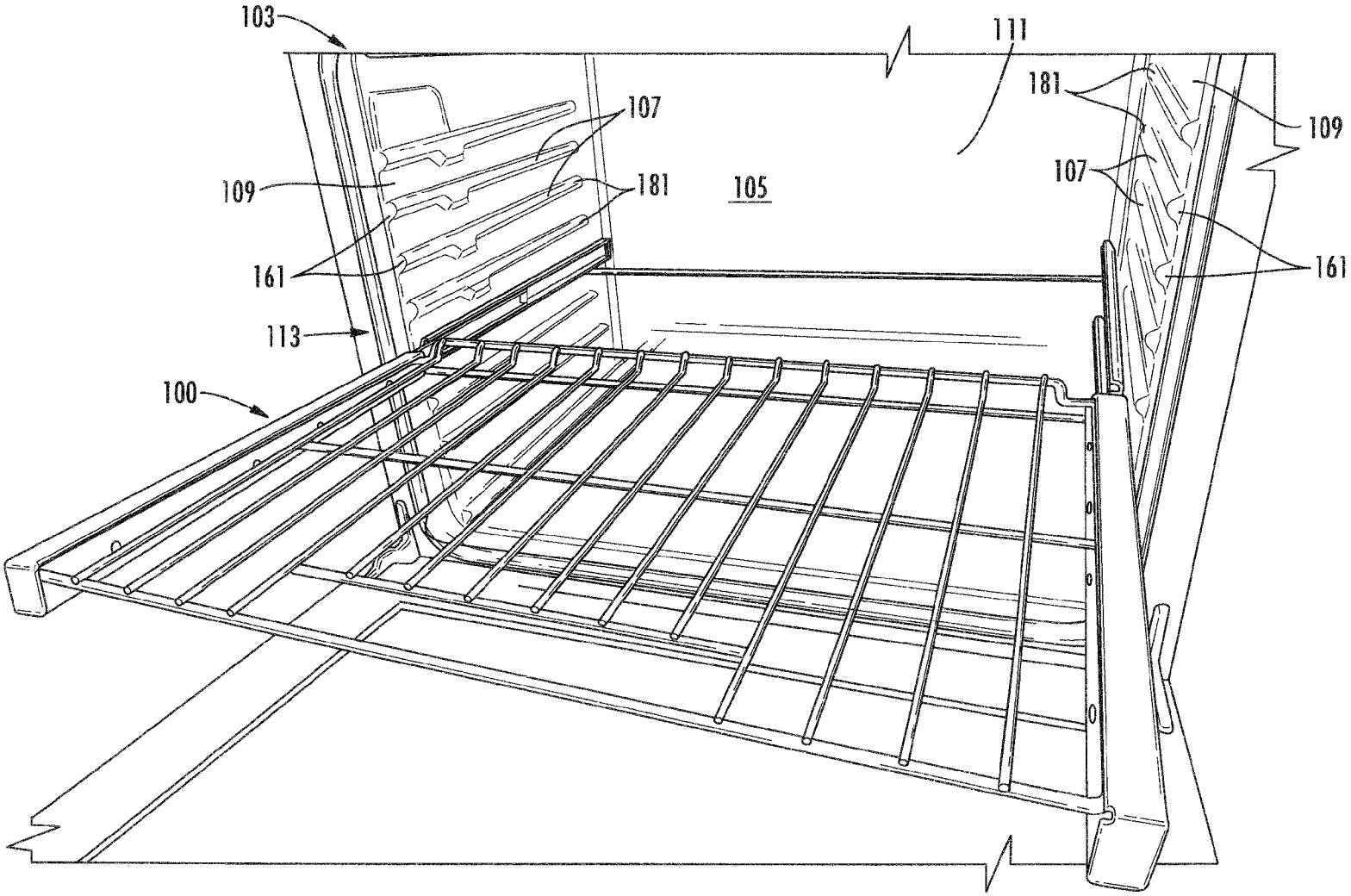
FIG. 1B illustrates the interior of the home appliance cavity with the telescopic rack of FIG. 1A in an extended position.

Referring now to the figures of the drawings in detail and first, particularly to FIGS. 1A and 1B, there are shown perspective views of a home appliance 103 with telescopic rack 100 in accordance with an exemplary embodiment of the present invention. Home appliance 103 includes a cavity 105 and ribs 107. Ribs 107 are formed in opposing interior side walls 109, of the cavity 105, and extend substantially horizontally from a back wall 111, of cavity 105 to a front portion 113, of cavity 105. Each of the ribs 107 has an opposing rib 107 formed in an opposing side wall 109 of cavity 105. Ribs 107 each include a front end portion 161 and a rear end portion 181. Cavity 105 may include multiple sets of opposing ribs 107 spaced one above another, such that a plurality of telescopic racks may be supported by the ribs 107, and/or may be raised or lowered with respect to the interior of cavity 105. FIG. 1A shows telescopic rack 100 in a fully retracted state within the cavity 105 of the home appliance 103. FIG. 1B shows telescopic rack 100 in extending out of cavity 105 of the home appliance 103.

Figure 2:
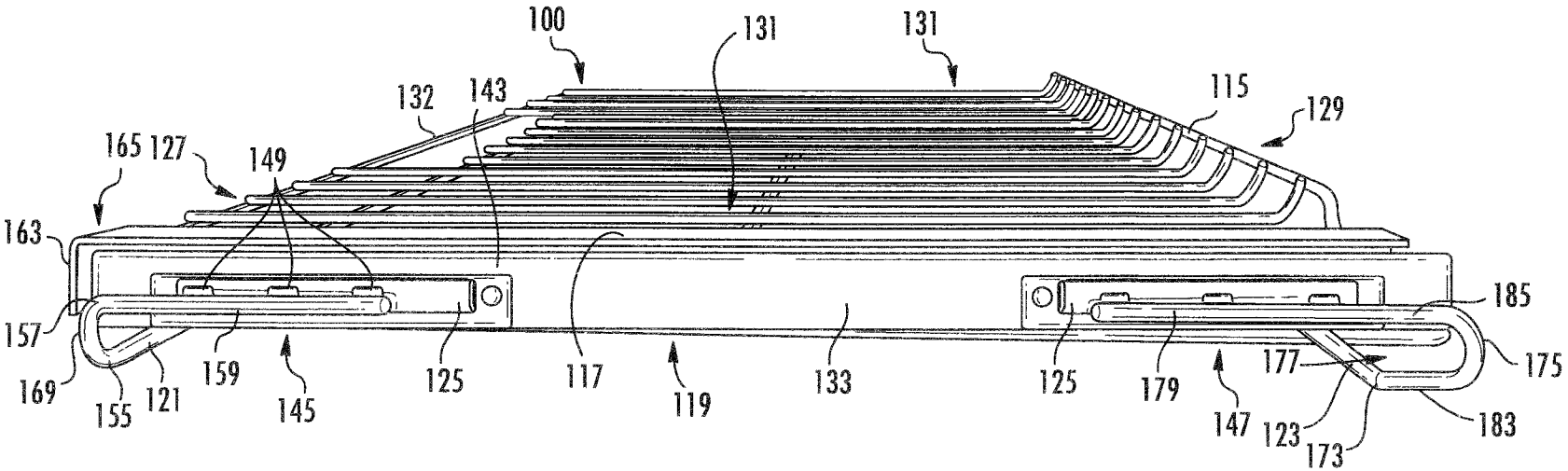
FIG. 2 illustrates a perspective view of a home appliance telescopic rack in accordance with an exemplary embodiment of the invention.
Figure 3:
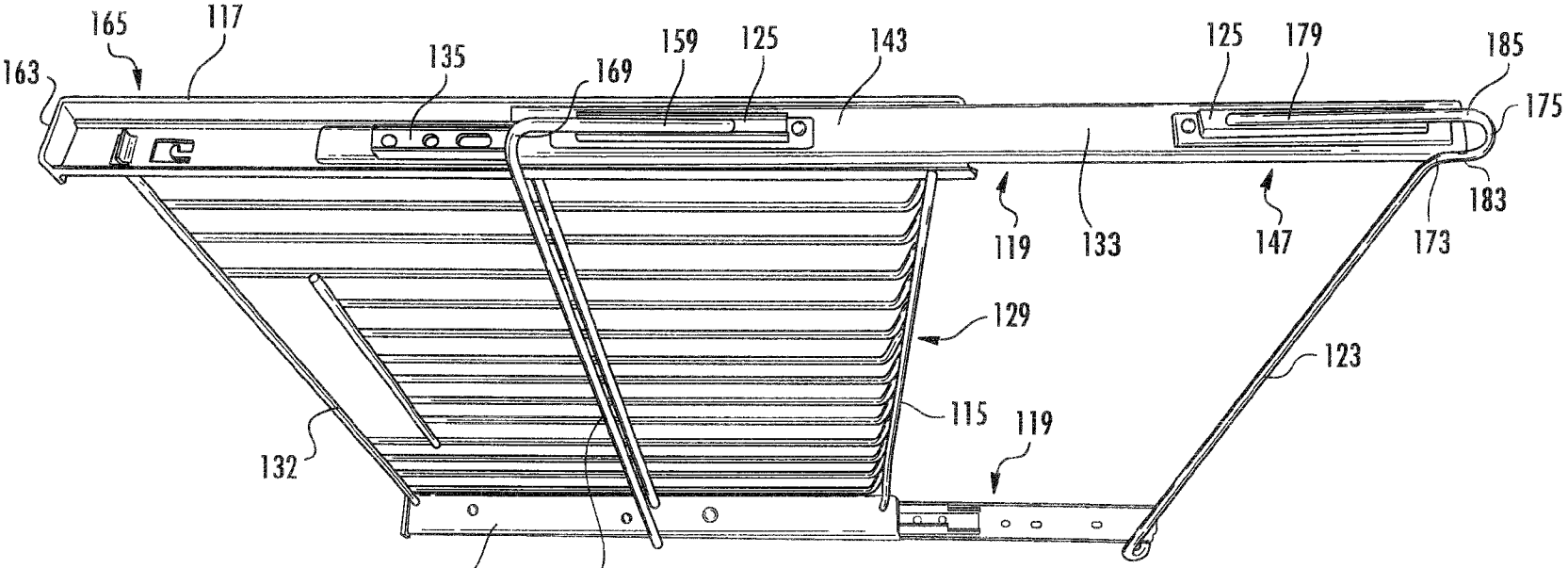
FIG. 3 illustrates a perspective view of the home appliance telescopic rack of FIG. 2.
Figure 4:
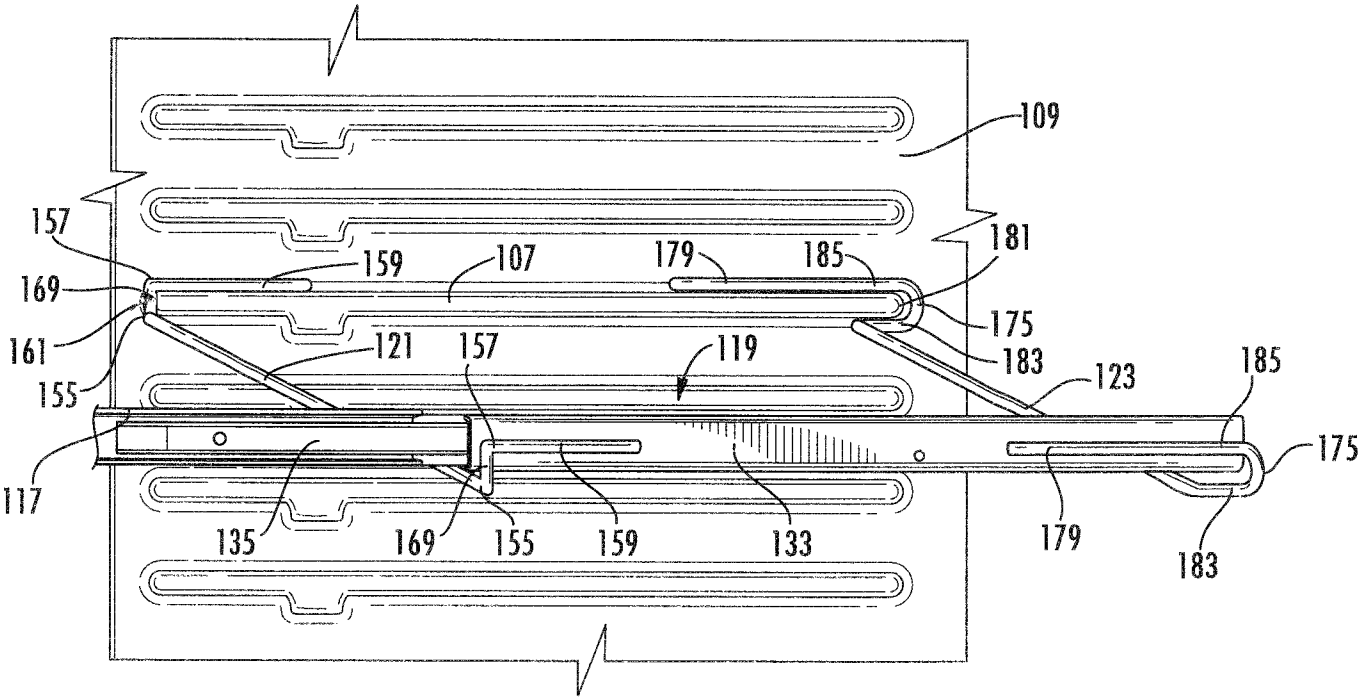
FIG. 4 illustrates a partial cross sectional view of an interior of a home appliance cavity showing a partial view of a telescopic rack in a partially extended position in accordance with an exemplary embodiment of the invention.

Referring now to FIGS. 2-4, the telescopic rack 100 includes a rack 115, braces 117, slides 119, a front brace 121, a rear brace 123, and rail brackets 125. Rack 115 includes a front edge 127, rear edge 129, two opposing side edges 131, and may optionally include a handle 132. Rack 115 is connected to braces 117 to support the rack 115 and to attach to slides 119. Braces 117 are attached to each of the two opposing side edges 131, and extend substantially the length of rack 115. Braces 117 are attached to rack 115 by any of a number of well-known mechanisms, such as, welding, rivets, clamps, clips, or the like.

Slides 119 are attached to each of braces 117 at each of the opposing side edges 131 of rack 115. The slides 119 may be attached to the braces 117 by any of a number of well-known mechanisms, such as, clips, tabs, welding, rivets, screws, nuts and bolts or the like. Slides 119 may be any of a number of conventional slide mechanisms having a bearing(s) such as a linear bearing(s), which are well known in the technology. In a non-limiting example, slides 119 each may include an outer rail 133, an inner rail 135, bearings 137, such as linear bearings (shown in FIG. 5), and a bearing rack 139 (shown in FIG. 5) to facilitate orienting and supporting ball bearings 137 between inner rail 135 and outer rail 133. Outer rail 133 may be slideably positioned with respect to inner rail 135. Ball bearings 137 facilitate sliding movement between outer and inner rails 133 and 135, respectively. In one embodiment, brace 117 is coupled to the inner rail 135 of slides 119. Slides 119 are attached to rail brackets 125. Rail brackets 125 are attached to an outer surface 143 of outer rail 133. In one embodiment, each outer rail 133 has rail brackets 125 attached to a front portion 145 and a rear portion 147 of the outer surface 143 of outer rail 133. The rail brackets 125 may be attached to outer rails 133 by any of a number of well-known mechanisms, such as, rivets, screws, nuts and bolts, tabs, clips, or the like.

Front brace 121 and rear brace 123 are proximate to the front edge 127 and rear edge 129, respectively, of the rack 115, and each extends horizontally from one opposing side portion 131 of rack 115 to the other opposing side portion 131 of rack 115, and are coupled to the slides 119, for example to the outer rails 133, via rail brackets 125. Front brace 121 is attached to rail brackets 125 that are attached to the slides 119 at the front portion 145 of the outer surface 143 of the outer rails 133, and rear brace 123 is attached to rail brackets 125 that are attached to the slides 119 at the rear portion 147 of the outer surface 143 of outer rails 133. Front brace 121 and rear brace 123 may be attached to rail brackets 125 by any of a number of well-known mechanisms, such as, welds 149, rivets, or the like. In one embodiment, front brace 121 and rear brace 123 are pre-attached (e.g., welded) to rail brackets 125 prior to the rail brackets 125 being attached to the slides 119. Preferably, at least a portion of front brace 121 is substantially parallel to the front edge 127 of rack 115, and a portion of rear brace 123 is substantially parallel to the rear edge 129 of the rack 115. Alternatively, front brace 121 and rear brace 123 may be attached directly to the front portion 145 and rear portion 147 of the outer surfaces 143 of outer rails 133, respectively. In such an embodiment, rail brackets 125 would not be required.

Attaching the front brace 121 and rear brace 123 to rail brackets 125 that are attached to the outer surface 143 of outer rails 133 creates a chassis for the telescopic rack 100 that maintains the structural integrity of the telescopic rack 100 and resists the slides 119, to which rack 115 is coupled, from warping, bending in, or skewing. This prevents the telescopic rack 100 from unintentionally disengaging from ribs 115 on the side walls 109 of oven cavity 105. Therefore, all the features required for the telescopic rack 100 to engage ribs 107, and to hold it in place, are integrated into the front brace 121 and rear brace 123, no additional components are required to maintain the structural integrity of the telescopic rack 100.

Front brace 121 extends horizontally substantially the width of, and substantially parallel with the front edge 127 of rack 115. Front brace 121 has an approximately 90° upward bend 155 followed by an approximately 90° horizontal bend 157, for example, in a direction toward the back wall 111 of the cavity 105, formed at each end of front brace 121. Front brace 121 further includes front brace attachment portions 159 extending substantially horizontally from, and in substantially the same direction as, horizontal bend 157. Front brace attachment portions 159 are attached to rail brackets 125 as described above. Upward bend 155 and horizontal bend 157 secure the telescopic rack 100 by capturing front end portions 161 of a set of opposing ribs 107, such that, when the rack 115 is pushed in, to retract the rack 115 into the cavity, the telescopic rack 100 does not contact the back wall 111 of the cavity 105. A front portion 165 of each rack brace 117 includes end caps 163. End caps 163 catch a portion of slides 119 when the rack 115 is retracted into the cavity. For example, a front most end of front portion 145 of the outer rail 133 and/or a portion 169 of front brace 121. Portion 169 includes a section of front brace 121 extending between upward bend 155 and horizontal bend 157. End caps 163 prevent the front edge 127 of rack 115 from being retracted past the front most end portion 145 and/or portion 169 of front brace 121, thus, preventing the rack 115 from being over retracted and colliding with the back wall 111 of the cavity 105 and/or becoming decoupled from slide rails 119.

Rear brace 123 extends horizontally substantially the width of, and substantially parallel with the rear edge 129 of rack 115. Rear brace 123 has an approximately 90° horizontal bend 173, for example in a direction toward the back wall 111 of the cavity 105, followed by a substantially "U" shaped bend 175, formed at each end of rear brace 123. The "U" shaped bend 175 is oriented such that an open portion 177 of the "U" shaped bend 175 faces the front portion 113 of oven cavity 105. Rear brace 123 includes rear brace attachment portions 179 extending substantially horizontally from, and in substantially the same direction as, a segment 185 of "U" shaped bend 175. Rear brace attachment portions 179 are attached to rail brackets 125 as described above. "U" shaped bend 175 functions to secure the telescopic rack 100 by looping around and capturing rear end portions 181 of a set of opposing ribs 107 in the "U" shaped bend 175, such that, when the rack 115 extends out of the cavity, the telescopic rack 100 is prevented from being pulled completely out of the cavity 105. Further, as the "U" shaped bend 175 loops around and captures the rear end portions 181 of ribs 107 (for example, segments 183 and 185 of the "U" shape are positioned above and below rear end portions 181 respectively), this also prevents the telescopic rack 100 from tipping downward when extended out of the cavity, thus, when extended and under load (e.g., having a food item and/or cookware loaded thereon), the telescopic rack 100 is securely held in a stable and substantially horizontal position.

Figure 5:
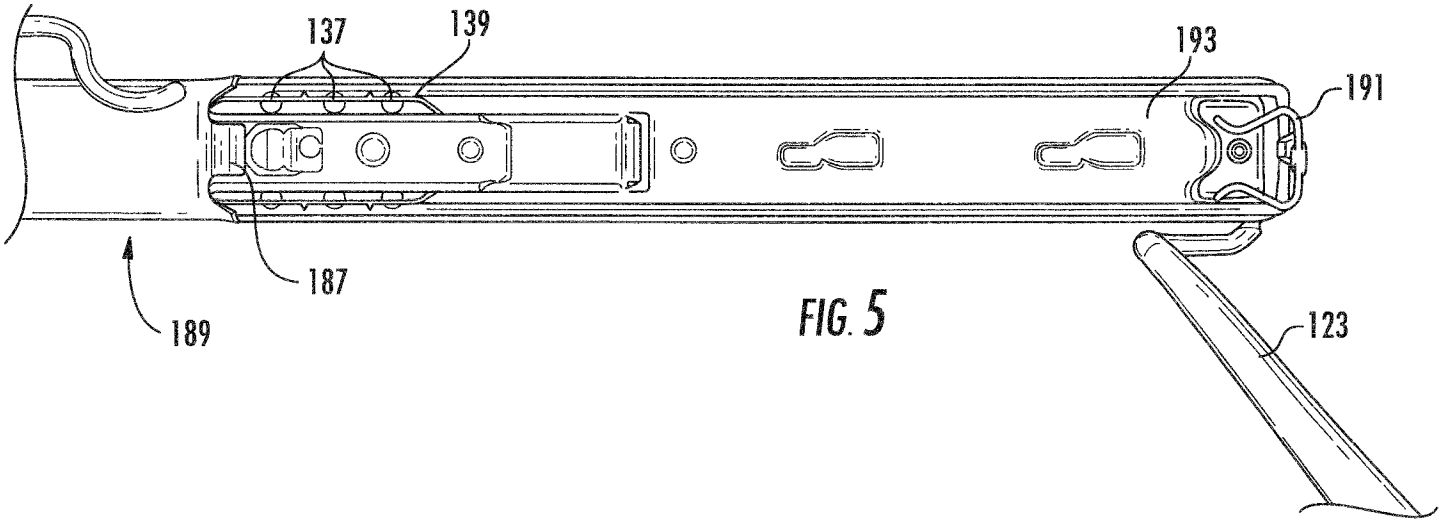
FIG. 5 illustrates a rear portion of a slide rail of a home appliance telescopic rack in accordance with an exemplary embodiment of the invention.

Referring now to FIG. 5, the exemplary embodiment of the telescopic rack 100 includes tabs 187 that prevent the rack 115 extending too far and decoupling from slides 119. Tabs 187 are on a rear portion 189 of rack braces 117. Tabs 187 are at a substantially 90° angle and substantially perpendicular to the rack brace 117. The tabs 187 are angled in toward their associated slide rail 119, such that tabs 187 are capable of engaging an opposing tab (not shown) formed at a front portion 145 of slide members 119 positioned, such that, when tabs 187 engage the opposing tabs the rack 115 cannot be extended further.

Telescopic rack 100 may further include clips 191. Clips 191 may be attached at the rear portion 147 of slides 119. Clips 191 are attached to an inner surface 193 of outer rails 133. Clips 191 are positioned and configured, such that they are capable of retaining rack 115, for example by engaging rack braces 117, when rack 115 is fully retracted into the oven cavity. In one example, clips 191 are capable of engaging with (e.g., clipping to), tabs 187. Clips 191 facilitate holding the rack 115 in a retracted position within the oven cavity. Clips 191 may be spring, pressure clips or other suitable type clip/retaining mechanism.

To install the telescopic rack 100 into the cavity 105 of the home appliance 103, the telescopic rack 100 is slid into the cavity 105 between a set of opposing ribs 107. The telescopic rack 100 is slid toward the back wall 111 of cavity 105 and then tilted slightly upward and pushed in a down/rearward direction to allow the open portion 177 of the "U" shaped bend 175 to align with the rear end portions 181 of the ribs 107. Once aligned, the telescopic rack 100 is returned to a substantially horizontal position and pulled forward such that the "U" shaped bends 175 engage and capture the rear end portions 181 of the ribs 107. Portion 169 of the front brace 121 captures the front end portions 161 of the ribs 107. The telescopic rack 100 is supported on the ribs 107 by front brace 121 and rear brace 123, in one embodiment, specifically by front brace attachment portions 159 and by rear brace attachment portions 179.

To remove the telescopic rack 100 from the cavity 105 the above process is reversed. In particular, the front edge 127 of telescopic rack 100 is tilted in an upward direction (for example, by using handle 132), such that portion 169 clears the front end portions 161 of the ribs 107, and pushed in a slightly down/rearward direction. Tilting and pushing the telescopic rack 100 in this manner acts to disengage the "U" shaped bends 175 of the rear wire brace 123 from the rear end portions 181 of ribs 107. Once disengaged, the telescopic rack 100 may be pulled upward slightly to allow the "U" shaped bends 175 of the rear brace 123 to clear the rear end portions 181 of the ribs 107, and then the telescopic rack 100 is tilted in a downward direction to a substantially horizontal position. The telescopic rack 100, once disengaged from the rear end portions 181 of the ribs 107, may then be slid completely out of the cavity 105.

The present invention has been described in terms of exemplary embodiments. However, modifications and additions to these embodiments are apparent to those of ordinary skill in the art. It is intended that all such modifications and additions comprise a part of the present invention.

What is claimed is:

1. A home appliance with a telescopic rack, comprising:
an appliance cavity with an opposing set of ribs on opposing walls of the appliance cavity;
a rack with opposing side edges;
a slide coupled to each of the opposing side edges; and
a front brace and a rear brace attached to a front portion and rear portion, respectively, of each slide, wherein the front brace is configured to engage a front portion of the opposing set of ribs at a front portion of the appliance cavity and the rear brace is configured to substantially loop around a rear most portion of the opposing set of ribs proximal to a back wall of the appliance cavity, wherein the front brace and rear brace are both concurrently engaged with their respective portions of the opposing set of ribs, wherein the front and rear braces on opposing sides are engaged to the same rib of the opposing set of ribs.

2. The home appliance of claim 1, wherein the slide is coupled to each of the opposing side edges with a rack brace.

3. The home appliance of claim 2, further comprising a tab on a rear portion of the rack brace that engages a front portion of the slide to prevent the rack from being decoupled from the slide.

4. The home appliance of claim 2, further comprising a retaining clip at a rear portion of the slide that engages the rack brace when the rack is fully retracted into the appliance cavity.

5. The home appliance of claim 2, wherein the rack brace comprises an end cap at a front portion of the rack brace, wherein the end cap catches a front portion of the slide or a portion of the front brace to prevent the rack from retracting past a certain position into the appliance cavity.

6. The home appliance of claim 1, wherein the front brace and rear brace are each coupled to each slide with a rail bracket.

7. The home appliance of claim 6, wherein each rail bracket is attached to an outer surface of the slide.

8. The home appliance with a telescopic rack of claim 1, wherein the appliance comprises an oven.

9. The home appliance of claim 1, wherein the front brace comprises:

a portion extending substantially the entire width of and substantially parallel to a front edge of the rack; and an upward bend portion and a horizontal bend portion at each end of the front brace.

10. The home appliance of claim 9, wherein the upward bend portion and horizontal bend portion are configured to engage the front portion of the opposing set of ribs.

11. The home appliance of claim 9, wherein the upward bend portion and the horizontal bend portion are each approximately 90 degree bends, and the horizontal bend portion extends toward a rear direction of the cavity.

12. The home appliance of claim 1, wherein the rear brace comprises:

a portion extending substantially a width of, and substantially parallel to a rear edge of the rack; and a horizontal bend portion and a substantially "U" shaped bend portion at each end of the rear brace.

13. The home appliance of claim 12, wherein the horizontal bend portion and "U" shaped bend portion are configured to substantially loop around the rear most portion of the opposing set of ribs.

14. The home appliance of claim 12, wherein the horizontal bend portion is approximately 90 degrees and extends toward a rear direction of the cavity and an open portion of the "U" shaped bend portion is orientated toward a front portion of the cavity.

15. The home appliance of claim 12, wherein the "U" shaped bend portion substantially loops around to capture the rear most portion of the opposing set of ribs.

16. The home appliance of claim 1, wherein the slide comprises:

an outer rail;

an inner rail; and a bearing rack slideably coupling the outer rail to the inner rail, wherein the opposing side edges of the rack are coupled to the slide inner rail.

17. A telescopic rack for use in an appliance, comprising:

a rack with opposing side edges;

a slide coupled to each of the opposing side edges; and a front brace and a rear brace attached to a front portion and rear portion respectively of each slide, wherein the front brace is configured to engage a front portion of an opposing set of ribs at a front portion of an appliance cavity, and the rear brace is configured to substantially loop around a rear most portion of the opposing set of ribs proximal to a back wall of the appliance cavity, wherein the front brace and rear brace are both concurrently engaged with their respective portions of the opposing set of ribs, wherein the front and rear braces on opposing sides are configured to engage the same rib of the opposing set of ribs.

18. The telescopic appliance rack of claim 17, wherein the slide is coupled to each of the opposing side edges with a rack brace.

19. The telescopic appliance rack of claim 18, further comprising a tab on a rear portion of the rack brace that engages a front portion of the slide to prevent the rack from being decoupled from the slide.

20. The telescopic appliance rack of claim 18, further comprising a retaining clip at a rear portion of the slide that engages the rack brace when the rack is fully retracted into the appliance cavity.

21. The telescopic appliance rack of claim 18, wherein the rack brace comprises an end cap at a front portion of the rack brace, wherein the end cap catches a front portion of the slide or a portion of the front brace to prevent the rack from retracting past a certain position into the appliance cavity.

22. The telescopic appliance rack of claim 17, wherein the front brace and rear brace are each coupled to each slide with a rail bracket.

23. The telescopic appliance rack of claim 22, wherein each rail bracket is attached to an outer surface of the slide.

24. The telescopic appliance rack of claim 17, wherein the front brace comprises:

a portion extending substantially the entire width of and substantially parallel to a front edge of the rack; and an upward bend portion and a horizontal bend portion at each end of the front brace.

25. The telescopic appliance rack of claim 24, wherein the upward bend portion and horizontal bend portion are configured to engage the front portion of the opposing set of ribs.

26. The telescopic appliance rack of claim 24, wherein the upward bend portion and the horizontal bend portion are each approximately 90 degree bends, and the horizontal bend portion extends toward a rear direction of the cavity.

27. The telescopic appliance rack of claim 17, wherein the rear brace comprises:

a portion extending substantially a width of, and substantially parallel to a rear edge of the rack; and a horizontal bend portion and a substantially "U" shaped bend portion at each end of the rear brace.

28. The telescopic appliance rack of claim 27, wherein the horizontal bend portion and "U" shaped bend portion are configured to substantially loop around the rear most portion of the opposing set of ribs.

29. The telescopic appliance rack of claim 27, wherein the horizontal bend portion is approximately 90 degrees and extends toward a rear direction of the cavity and an open portion of the "U" shaped bend portion is orientated toward a front portion of the cavity.

30. The telescopic appliance rack of claim 29, wherein the "U" shaped bend portion substantially loops around to capture the rear most portion of the opposing set of ribs.

31. The telescopic appliance rack of claim 17, wherein the slide comprises:

an outer rail;

an inner rail; and a bearing rack slideably coupling the outer rail to the inner rail, wherein the opposing side edges of the rack are coupled to the slide inner rail.

32. The telescopic appliance rack of claim 17, wherein the appliance comprises an oven.

* * * * *